US010745229B2

(12) United States Patent
Trainer, Jr. et al.

(10) Patent No.: US 10,745,229 B2
(45) Date of Patent: Aug. 18, 2020

(54) METHODS AND SYSTEMS FOR CONVERTING AND PACKAGING CORELESS PAPER PRODUCTS

(71) Applicant: GPCP IP Holdings LLC, Atlanta, GA (US)

(72) Inventors: Nicholas P. Trainer, Jr., Alpharetta, GA (US); Thomas I. Stafford, III, Roswell, GA (US); Richard J. Bigari, Suamico, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 2153 days.

(21) Appl. No.: 13/888,435

(22) Filed: May 7, 2013

(65) Prior Publication Data

US 2013/0299622 A1 Nov. 14, 2013

Related U.S. Application Data

(60) Provisional application No. 61/644,195, filed on May 8, 2012.

(51) Int. Cl.
*B65H 18/00* (2006.01)
*B65H 18/08* (2006.01)
(Continued)

(52) U.S. Cl.
CPC ..... *B65H 18/08* (2013.01); *B65H 19/2276* (2013.01); *B65H 35/02* (2013.01);
(Continued)

(58) Field of Classification Search
CPC ..... B65H 75/00; B65H 75/24; B65H 75/242; B65H 75/243; B65H 2301/41484;
(Continued)

(56) References Cited

U.S. PATENT DOCUMENTS 4,135,677 A * 1/1979 Warczak ..... B65H 75/243 242/571.1
4,802,637 A * 2/1989 Williams ..... B23B 31/40 242/571.4

(Continued)

*Primary Examiner* — Andrew M Tecco
*Assistant Examiner* — Eyamindae C Jallow
(74) *Attorney, Agent, or Firm* — Eversheds Sutherland (US) LLP

(57) ABSTRACT

A method of converting a plurality of coreless roll products includes providing a first support structure and winding a paper product around the first support structure. The method also includes cutting through the paper product and the first support structure to form a plurality of cut portions of the paper product each wound around a cut portion of the first support structure. The method further includes removing the cut portion of the first support structure from each of the cut portions of the paper product to form a plurality of coreless roll products each comprising a center aperture. A method of preparing a coreless roll product for storage or shipment includes providing a coreless roll product comprising a center aperture and inserting a temporary support device into the center aperture of the coreless roll product. The method also includes expanding the temporary support device to approximate dimensions of the center aperture, wherein the temporary support device is configured to reduce deformation of the center aperture during storage or shipment.

20 Claims, 7 Drawing Sheets

(51) Int. Cl.
*B65H 19/22* (2006.01)
*B65H 35/02* (2006.01)

(52) U.S. Cl.
CPC ..... *B65H 2301/41484* (2013.01); *B65H 2301/543* (2013.01)

(58) Field of Classification Search
CPC ..... B65H 2301/41485; B65H 2301/41854; B65H 19/2292; B65H 19/2276
USPC ..... 53/118, 430, 435, 520, 581; 83/294; 242/570–576, 600, 159
See application file for complete search history.

(56) References Cited

U.S. PATENT DOCUMENTS 4,977,803 A * 12/1990 Blom ..... B23D 47/042 198/693
5,352,319 A * 10/1994 Ishizu ..... B65H 19/22 156/184
5,377,831 A * 1/1995 Crooks ..... B65D 59/02 206/394
5,904,315 A * 5/1999 McInerney ..... B65H 75/24 242/571
2006/0006089 A1* 1/2006 Arash ..... A47K 10/16 206/410
2007/0095693 A1* 5/2007 De Luca ..... B65B 9/045 206/389
2009/0289137 A1* 11/2009 Fischer ..... A47K 10/3827 242/170
2011/0114778 A1* 5/2011 Andersson ..... A47K 10/40 242/160.1
2012/0025003 A1* 2/2012 Larsson ..... B65H 19/305 242/571

* cited by examiner

METHODS AND SYSTEMS FOR CONVERTING AND PACKAGING CORELESS PAPER PRODUCTS

CROSS-REFERENCE TO RELATED APPLICATIONS

This application claims the benefit of U.S. Provisional Application No. 61/644,195, filed on May 8, 2012, which is incorporated herein by reference in its entirety.

BACKGROUND

The present invention generally relates to the field of paper products, and more specifically, to systems and methods for converting and packaging coreless paper products.

Rolled paper products, such as bath tissue, are generally provided in one of two forms, coreless rolls or cored rolls. Cored rolls are commonly used for residential and light commercial use and include a supporting tube disposed in the center aperture of the roll with the tissue product wrapped around the supporting tube. Coreless rolls are commonly used in commercial buildings and generally include tissue wound very densely around a small center aperture. However, since coreless roll products do not include a supporting tube to provide stability, the coreless roll products are prone to being crushed during shipment or storage. When a coreless roll product is crushed, i.e., when the center aperture of the coreless roll is at least partially deformed, the coreless roll product may be difficult to insert onto a spindle for dispensing.

Current coreless tissue products have typically been manufactured with center apertures that are considerably smaller in diameter compared to the center aperture of traditional cored products, which increases capacity and minimizes the occurrence of crushing of the center aperture. Furthermore, traditional commercial coreless tissue products are not sized for use with dispensers designed for traditional cored roll tissue products.

BRIEF SUMMARY

In an exemplary embodiment, a method of converting a plurality of coreless roll products includes providing a first support structure and winding a paper product around the first support structure. The method also includes cutting through the paper product and the first support structure to form a plurality of cut portions of the paper product each wound around a cut portion of the first support structure. The method further includes removing the cut portion of the first support structure from each of the cut portions of the paper product to form a plurality of coreless roll products each comprising a center aperture.

In another exemplary embodiment, a method of preparing a coreless roll product for storage or shipment includes providing a coreless roll product comprising a center aperture and inserting a temporary support device into the center aperture of the coreless roll product. The method also includes expanding the temporary support device to approximate dimensions of the center aperture, wherein the temporary support device is configured to reduce deformation of the center aperture during storage or shipment.

In a further exemplary embodiment, a method of converting a plurality of coreless roll products and preparing the coreless roll products for storage or shipment includes providing a first support structure and winding a paper product around the first support structure. The method also includes cutting through the paper product and the first support structure to form a plurality of cut portions of the paper product each wound around a cut portion of the first support structure. The method further includes removing the cut portion of the first support structure from each of the cut portions of the paper product to form a plurality of coreless roll products each comprising a center aperture. The method also includes inserting a temporary support device into the center aperture of one or more of the coreless roll products. The method further includes expanding the temporary support device to approximate dimensions of the center aperture, wherein the temporary support device is configured to reduce deformation of the center aperture during storage or shipment.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

In exemplary embodiments, methods and systems are provided for converting and packaging a coreless roll product. As used herein, the term coreless roll product refers to a rolled paper product that has a center aperture which does not include a supporting tube in the center aperture. In exemplary embodiments, the center aperture can range from approximately one half inch to four inches in diameter, or about 10 to 100 millimeters. In exemplary embodiments, the coreless roll products can include a wide variety of paper products such as bath tissue, paper towels, napkins, thermal paper, or the like.

Figure 1:
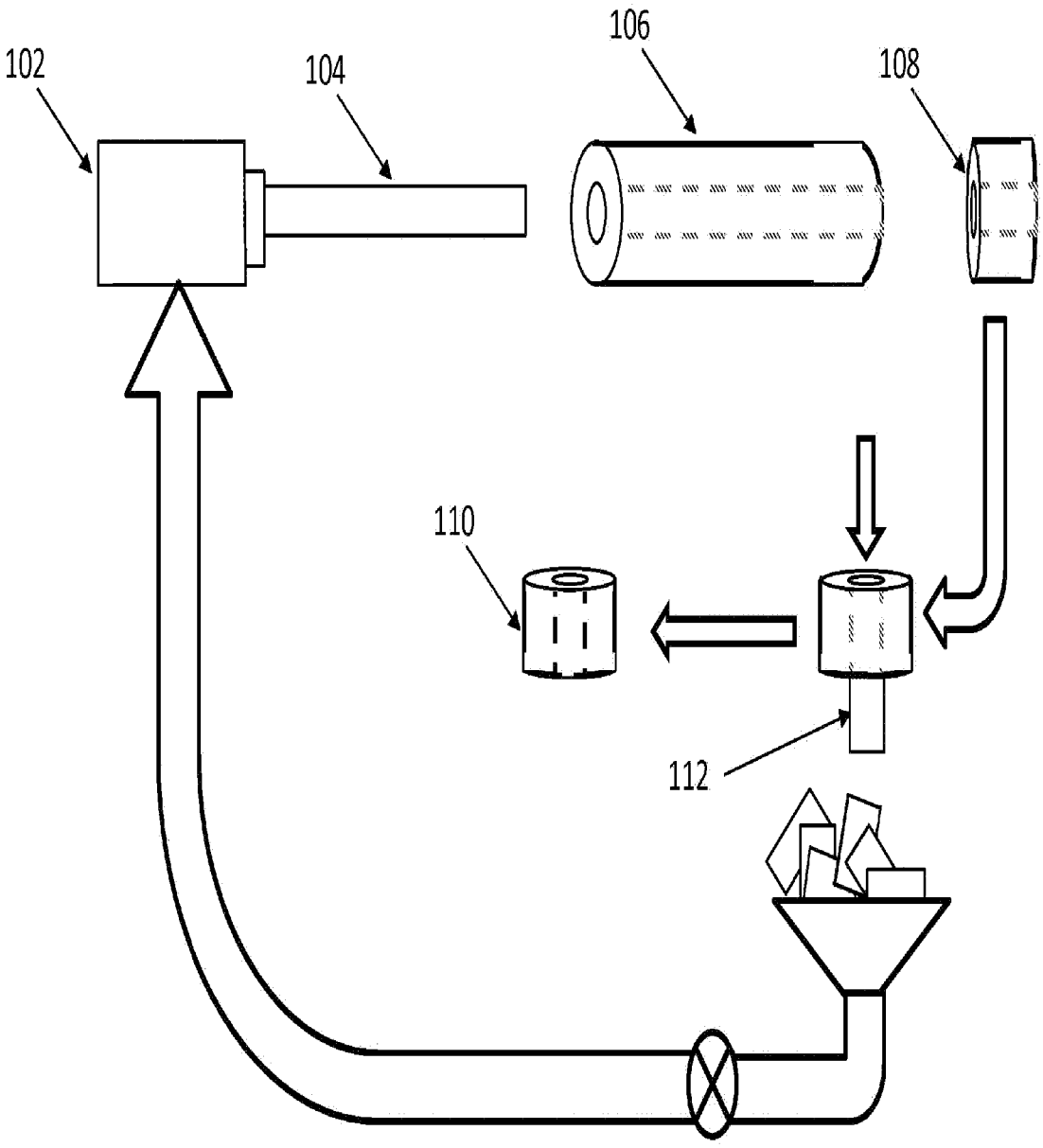
FIG. 1 is a block diagram illustrating a method for converting a coreless roll product in accordance with an exemplary embodiment.

Referring now to FIG. 1 a block diagram illustrating a method for converting a coreless roll product in accordance with an exemplary embodiment is shown. As illustrated, the method includes using a forming device 102 to form a support structure 104. In an exemplary embodiment, the support structure 104 is designed to have a diameter approximately equal to the diameter of a traditional supporting tube used in cored roll paper products, i.e., one and a half to two inches, or about 35 to 50 millimeters. Once the support structure 104 has been formed, a paper product is then wound around the support structure 104 to form a log 106. In exemplary embodiments, the support structure 104 may be treated or coated with a material suitable to prevent the paper product from adhering to the support structure 104 after winding. After the log 106 is formed, it is then cut into several roll products 108. The cut portions 112 of the support structure 104 are then removed from the center apertures of the roll products 108 to form coreless roll products 110. In exemplary embodiments, the cut portions 112 of the support structure 104 may be recycled and reused by the forming device 102 to form additional support structures 104.

In exemplary embodiments, the method for converting a coreless roll product utilizes much of the same equipment and process used to convert cored roll paper products. For example, in an embodiment where the support structure 104 is designed to have the same diameter as cores used in traditional cored products, the same machines and processes can be used to wind the product around the support structure 104 that are currently used to wind products around supporting tubes of cored roll products. For example, a winding nest that is configured for winding paper product from a parent roll onto a traditional core can be used to wind the paper product from the parent roll onto the support structure 104. Likewise, the same machines and processes can also be used to cut the log 106 into several roll products 108 that are used to perform those corresponding functions in the converting of traditional cored paper products. For example, a log saw configured to cut a log of paper product with a traditional core can be used to cut the log 106.

Figure 2A:
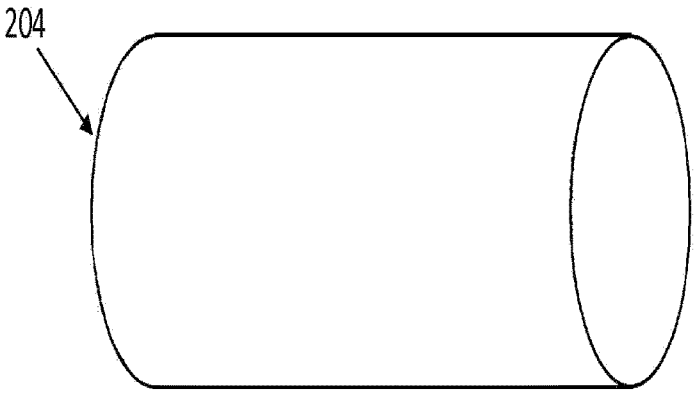
FIGS. 2A and 2B are perspective views of exemplary support structures for use in the method illustrated in FIG. 1.
Figure 2B:
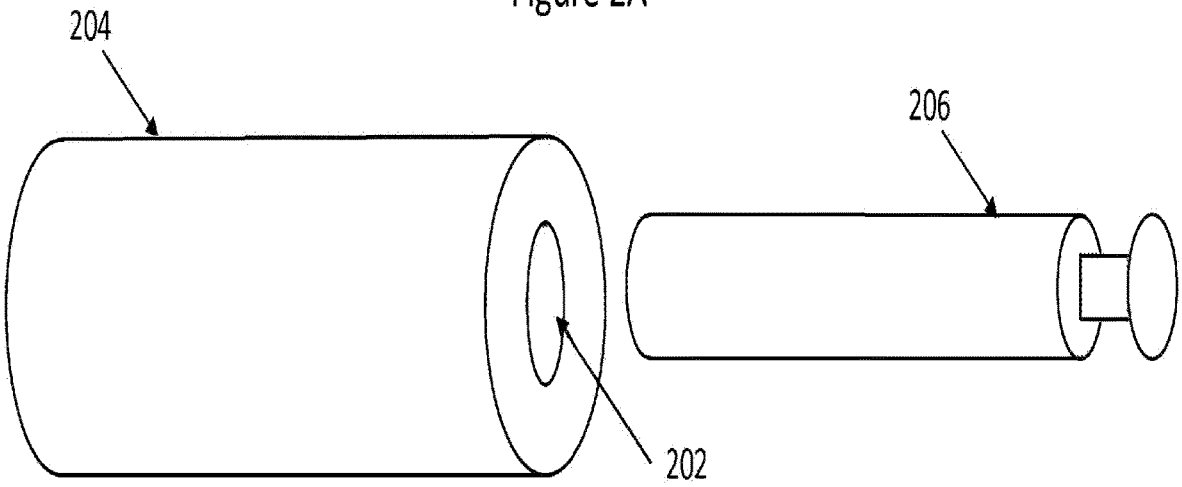

Turning now to FIGS. 2A and 2B, exemplary embodiments of support structures 204 for use in the method illustrated in FIG. 1 are shown. In exemplary embodiments, the support structure 204 may be made of any material that is suitably rigid to wind the paper product around and which is capable of being cut by a log saw, or other similar mechanism. In exemplary embodiments, the support structure 204 may be constructed out of a variety of materials including, but not limited to, paper, plastic, foam and the like. In addition, depending on the material selected for the support structure 204, the support structure 204 may be coated or treated to prevent the paper product from adhering to the support structure 204 after winding and to facilitate removal of the cut portions of the support structure 204. In exemplary embodiments, the support structure 204 may be made out of a foam material and the forming device may be an extruder. However, it will be apparent to those of ordinary skill in the art that the support structure 204 may be constructed out of a range of suitable materials.

As illustrated in FIGS. 2A and 2B, the support structure 204 may have a solid construction or may be constructed with a center aperture 202. In exemplary embodiments, a rigid mandrel 206 can be inserted into the center aperture 202 of the support structure 204 before the paper product is wound around the support structure 204 to provide added stability to the support structure 204 during the process of winding the paper product. If used during winding, the mandrel 206 is then removed from the log prior to the log being cut into roll products. In another embodiment, the support structure 204 may be designed to have a suitably rigid construction suitable for winding the paper product around support structure 204 without the need for a mandrel 206.

Figure 3A:
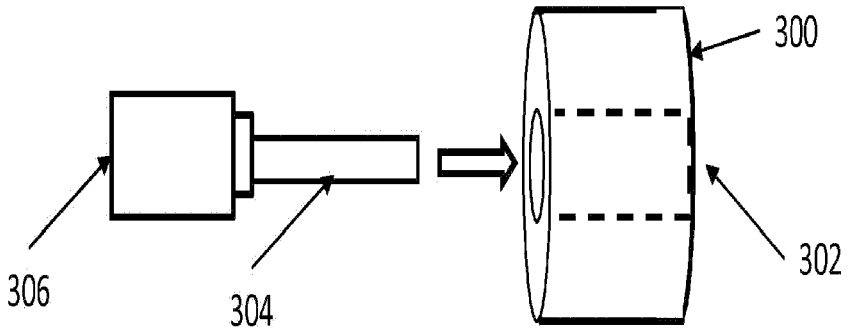
FIGS. 3A, 3B, 3C and 3D are perspective views illustrating the steps of a method for preparing one or more a coreless roll products for packaging in accordance with an exemplary embodiment.
Figure 3B:
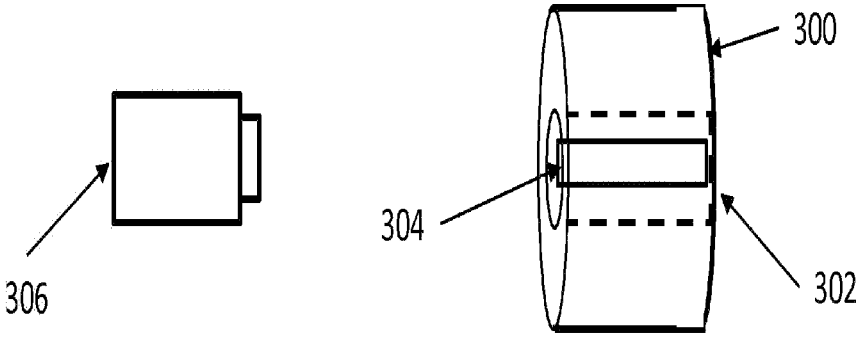
Figure 3C:
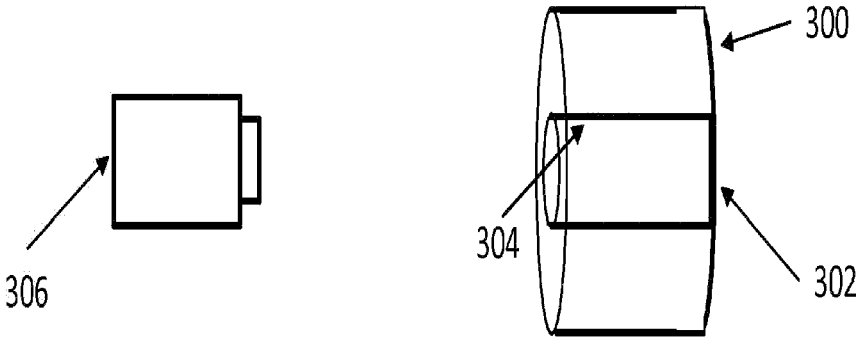

Referring now to FIGS. 3A-3C, a coreless roll product 300 constructed in accordance with the method depicted in FIG. 1 is shown. The coreless roll product 300 includes a center aperture 302. In exemplary embodiments, a support device 304 is inserted into the center aperture 302 of the coreless roll product 300 to prevent the center aperture 302 from being crushed or deformed during shipment or storage. In an exemplary embodiment, the support device 304 may be made by a forming device 306 prior to being inserted into the center aperture 302. In one embodiment, the support device 304 may be a plastic bag, or balloon, that is formed and then inserted into the center aperture 302. Once the plastic bag is inserted into the center aperture 302, it is then inflated to provide support for the center aperture 302. Alternatively, the plastic bag may be partially or fully inflated prior to being inserted into the center aperture 302.

Figure 3D:
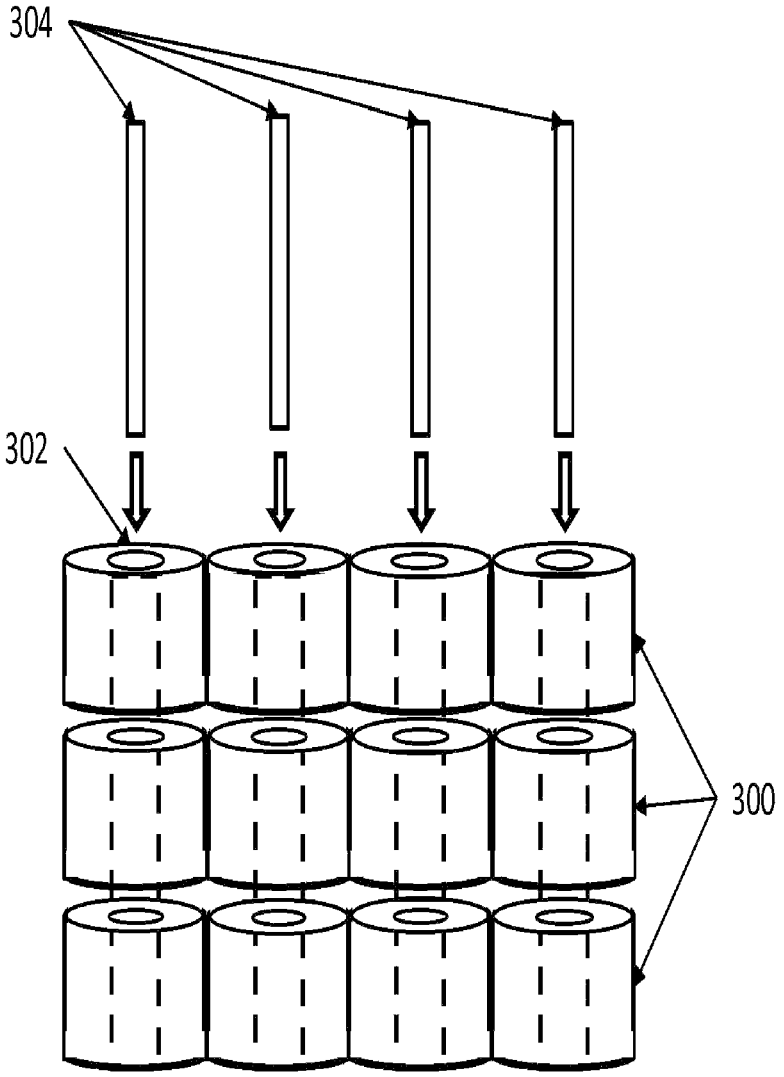

Referring now to FIGS. 3D, coreless roll products 300 constructed in accordance with the method depicted in FIG. 1 are shown. The coreless roll products 300 may be stacked or disposed in a variety of arrangements for packaging purposes. Once the coreless roll products 300 have been arranged, one or more support devices 304 can be inserted into the center apertures 302. In one embodiment, a single support device 304 may be disposed through the center apertures 302 of two or more adjacently disposed coreless roll products 300, as best illustrated in FIG. 3D. In another embodiment, each support device 304 may be designed to be used with a single coreless roll product 300, as best illustrated in FIGS. 3A-3C. Once the support device 304 is placed into the center aperture 302 of the coreless roll product 300, the coreless roll product 300 can be prepared for shipment by encasing the arrangement of coreless roll products 300 in an outer wrapping. In exemplary embodiments, the coreless roll products 300 may be individually wrapped. In exemplary embodiments, the coreless roll product(s) can be wrapped in plastic, paper, polythene wrap, or the like.

In exemplary embodiments, the support devices 304 may be any suitable device that can be inserted into the center aperture 302 of the coreless roll product 300 that provides sufficient structural support to the coreless roll product 300 to reduce or prevent deformation or crushing of the center aperture 302 during shipment or storage. In addition, the support device 304 may be constructed such that the user of the coreless roll products 300 can remove the support device 304 from the center aperture 302 without substantially damaging the center aperture 302 of the coreless roll product 300.

Figure 4:
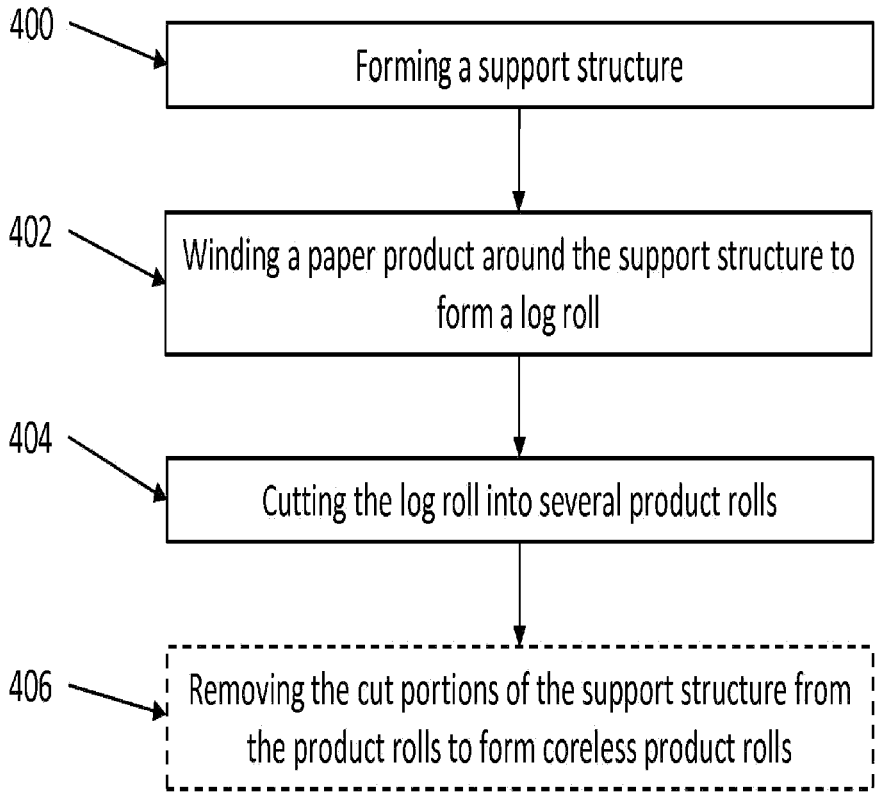
FIG. 4 is flow diagram illustrating a method for converting a coreless roll product in accordance with an exemplary embodiment.

Referring now to FIG. 4, a flow diagram illustrating a method for converting a coreless roll product in accordance with an exemplary embodiment is shown. As shown at block 400, the method includes forming a support structure. Next, as shown at block 402, the method includes winding a paper product around the support structure to form a log. In exemplary embodiments, the paper product may be fed from a parent roll into a winding nest to form the log. After the log is formed, it is cut into several roll products, as shown at block 404. As shown at block 406, the method may also include removing the cut portions of the support structure from the roll products to form coreless roll products. In exemplary embodiments, a cut portion of the support structure is capable of being removed from the roll product without damaging the roll product.

Figure 5:
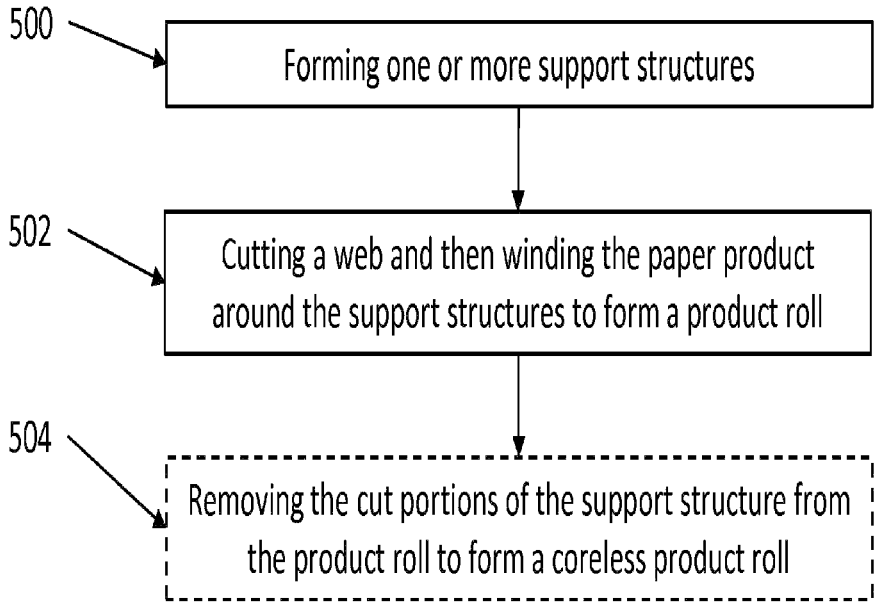
FIG. 5 is flow diagram illustrating another method for converting a coreless roll product in accordance with an exemplary embodiment.

Referring now to FIG. 5, a flow diagram illustrating another method for converting a coreless roll product in accordance with an exemplary embodiment is shown. As shown at block 500, the method includes forming one or more support structures. Next, as shown at block 502, the method includes cutting a web of product and then winding the paper product around the support structures to form a product roll. For example, a slitter rewinding machine may be used to cut the web of paper product as it is being received from a parent roll and to wind the cut paper product onto several support structures. As shown at block 504, the method may also include removing the cut portions of the support structure from the roll product to form a coreless roll product. In exemplary embodiments, a cut portion of the support structure is capable of being removed from the roll product without damaging the roll product.

Figure 6:
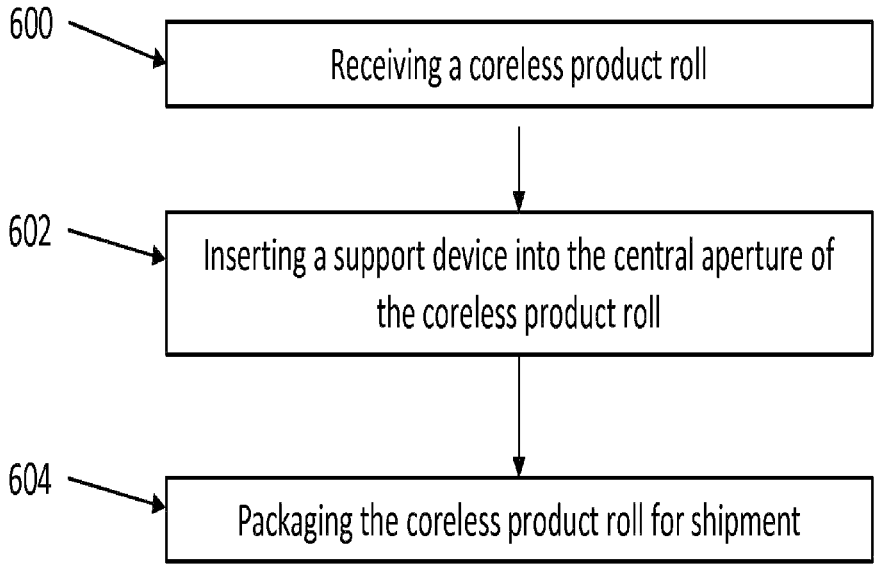
FIG. 6 is flow diagram illustrating a method for packaging a coreless roll product in accordance with an exemplary embodiment.

Referring now to FIG. 6, a flow diagram illustrating a method for packaging a coreless roll product in accordance with an exemplary embodiment is shown. As shown at block 600, the method includes receiving one or more coreless roll products. Next, as shown at block 602, the method includes inserting a support device into the central aperture of the coreless roll product. The method also includes packaging the coreless roll product for shipment, as shown at block 604.

In exemplary embodiments, the support device is at least partially disposed in the center aperture of the coreless roll product. In exemplary embodiments, the support device can designed to have a length such that the ends of the support device do not protrude from the coreless roll product. In exemplary embodiments, the support device may be inserted into the center aperture of the coreless roll product and expanded to the approximate dimensions of the center aperture of the coreless roll product. In one embodiment, the support device may be a balloon that is inserted into the center aperture of a coreless roll product. Once the balloon is disposed in the center aperture of the coreless roll product, the balloon is inflated, such that it expands to the approximate dimensions of the center aperture. In exemplary embodiments, the support structure used in forming the coreless roll products can be utilized as the support device for preventing the coreless roll products from deforming during shipment.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to these diagrams or the steps (or operations) described therein without departing from the spirit of the invention. For instance, the steps may be performed in a differing order or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method of converting a plurality of coreless roll products, the method comprising:

providing a first support structure;

winding a paper product around the first support structure;

cutting through the paper product and the first support structure to form a plurality of cut portions of the paper product each wound around a cut portion of the first support structure; and removing the cut portion of the first support structure from each of the cut portions of the paper product to form a plurality of coreless roll products each comprising a center aperture.

2. The method of claim 1, further comprising coating the first support structure with a coating material operable to reduce adhesion of the paper product to the first support structure.

3. The method of claim 1, further comprising, prior to winding the paper product around the first support structure, inserting a mandrel into a center aperture of the first support structure.

4. The method of claim 3, further comprising, after winding the paper product around the first support structure, removing the mandrel from the center aperture of the first support structure.

5. The method of claim 1, further comprising recycling the cut portions of the first support structure and forming a second support structure from the cut portions of the first support structure.

6. The method of claim 1, wherein winding the paper product around the first support structure comprises using a winding nest to wind the paper product from a parent roll onto the first support structure.

7. The method of claim 1, wherein cutting through the paper product and the first support structure comprises using a log saw.

8. The method of claim 1, wherein removing the cut portion of the first support structure from each of the cut portions of the paper product comprises removing the cut portion of the first support structure without damaging the cut portions of the paper product.

9. The method of claim 1, wherein the first support structure is formed of a foam material.

10. The method of claim 1, wherein the first support structure has a solid cylindrical shape.

11. The method of claim 1, wherein the first support structure has a tubular shape.

12. The method of claim 1, wherein providing the first support structure comprises using an extruder to form the first support structure.

13. A method of preparing a coreless roll product for storage or shipment, the method comprising:

providing a coreless roll product comprising a web of wound paper product and a center aperture defined by an inner layer of the web;

inserting a support device into the center aperture of the coreless roll product, wherein the support device comprises a balloon; and radially expanding the support device to approximate dimensions of the center aperture by inflating the balloon, wherein the support device is configured to reduce deformation of the center aperture during storage or shipment.

14. The method of claim 13, wherein radially expanding the support device to the approximate dimensions of the center aperture comprises frictionally engaging the coreless roll product about the center aperture.

15. The method of claim 13, wherein the center aperture of the coreless roll product has a first length, wherein the support device has a second length, and wherein the second length is equal to or greater than the first length.

16. The method of claim 13, further comprising, prior to inserting the support device into the center aperture, partially inflating the balloon to less than the approximate dimensions of the center aperture.

17. The method of claim 13, wherein inserting the support device into the center aperture of the coreless roll product comprises inserting the support device into center apertures of a plurality of coreless roll products.

18. The method of claim 13, further comprising encasing the coreless roll product in an outer wrapping for storage or shipment.

19. The method of claim 13, wherein the support device is configured to be removed from the center aperture without damaging the coreless roll product.

20. A method of converting a plurality of coreless roll products and preparing the coreless roll products for storage or shipment, the method comprising:

providing a first support structure;

winding a paper product around the first support structure;

cutting through the paper product and the first support structure to form a plurality of cut portions of the paper product each wound around a cut portion of the first support structure;

removing the cut portion of the first support structure from each of the cut portions of the paper product to form a plurality of coreless roll products each comprising a web of the wound paper product and a center aperture defined by an inner layer of the web;

inserting a support device into the center aperture of one or more of the coreless roll products, wherein the support device comprises a balloon; and radially expanding the support device to approximate dimensions of the center aperture by inflating the balloon, wherein the support device is configured to reduce deformation of the center aperture during storage or shipment.

* * * * *